US010641295B2

(12) United States Patent
Kloft et al.

(10) Patent No.: US 10,641,295 B2
(45) Date of Patent: May 5, 2020

(54) METHOD FOR PRODUCING A FOAM BODY

(71) Applicant: HYDAC TECHNOLOGY GMBH, Sulzbach/Saar (DE)

(72) Inventors: Peter Kloft, Ransbach-Baumbach (DE); Herbert Baltes, Losheim (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 237 days.

(21) Appl. No.: 15/552,840

(22) PCT Filed: Jan. 15, 2016

(86) PCT No.: PCT/EP2016/000073
§ 371 (c)(1),
(2) Date: Aug. 23, 2017

(87) PCT Pub. No.: WO2016/150535
PCT Pub. Date: Sep. 29, 2016

(65) Prior Publication Data
US 2018/0038391 A1 Feb. 8, 2018

(30) Foreign Application Priority Data
Mar. 20, 2015 (DE) ..... 10 2015 003 673

(51) Int. Cl.
*F15B 1/08* (2006.01)

(52) U.S. Cl.
CPC ..... *F15B 1/086* (2013.01); *F15B 2201/3152* (2013.01); *F15B 2201/3154* (2013.01); *F15B 2201/411* (2013.01); *F15B 2201/60* (2013.01)

(58) Field of Classification Search
CPC ..... F15B 2201/3154; F15B 1/086; F15B 2201/60; F15B 2201/411; F15B 2201/3152; B29C 44/587; B29C 44/386
See application file for complete search history.

(56) References Cited

U.S. PATENT DOCUMENTS 4,120,923 A * 10/1978 Kloker ..... B29B 7/7409 264/45.3
4,181,155 A * 1/1980 Wesselink ..... F15B 1/08 138/30

(Continued)

FOREIGN PATENT DOCUMENTS

DE 1 240 264 5/1967
DE 1240264 B * 5/1967 ..... B29C 41/14

(Continued)

OTHER PUBLICATIONS

International Search Report (ISR) dated Mar. 22, 2016 in International (PCT) Application No. PCT/EP2016/000073.

*Primary Examiner* — Joseph S Del Sole
*Assistant Examiner* — Jerzi H Moreno Hernandez
(74) *Attorney, Agent, or Firm* — Wenderoth, Lind & Ponack, L.L.P.

(57) ABSTRACT

A method for producing a foam body for a pressure or hydraulic accumulator has a bubble- or diaphragm-shaped, elastically flexible separating layer (12) separating gas and liquid chambers from each other within an accumulator housing. The production method includes introducing a flowable, preferably liquid, foam material into the pressure accumulator with the foam material being at least partially surrounded by the separating layer (12), curing the foam material in the hydraulic accumulator, and building up a pressure gradient in which the visibly curing foam material expands the separating layer (12) from an originally partially filled starting state in the direction of an end state in which the accumulator is finally filled with the cured foam (38).

19 Claims, 1 Drawing Sheet

(56) References Cited

U.S. PATENT DOCUMENTS

| | | | | | |
|---|---|---|---|---|---|
| 4,239,856 | A * | 12/1980 | Rowton | C08G 18/6688 521/118 |
| 4,367,786 | A | 1/1983 | Hafner et al. | |
| 4,522,578 | A * | 6/1985 | Martin, Jr. | B29C 44/386 249/91 |
| 4,851,167 | A * | 7/1989 | Marc | B29C 33/08 264/421 |
| 5,855,831 | A * | 1/1999 | Takei | B60N 2/80 264/46.6 |
| 2004/0009250 | A1* | 1/2004 | Schuermann | B29C 44/0492 425/4 R |
| 2010/0050622 | A1* | 3/2010 | Stroganov | F15B 1/04 60/413 |
| 2014/0299609 | A1 | 10/2014 | Baltes et al. | |
| 2014/0311603 | A1 | 10/2014 | Baltes et al. | |
| 2016/0326330 | A1* | 11/2016 | Schuette | C08J 9/0004 |

FOREIGN PATENT DOCUMENTS

| | | |
|---|---|---|
| DE | 29 47 258 | 5/1981 |
| WO | 2013/056834 | 4/2013 |
| WO | 2013/056835 | 4/2013 |

* cited by examiner

METHOD FOR PRODUCING A FOAM BODY

FIELD OF THE INVENTION

The invention relates to a method for producing a foam body, in particular for a pressure accumulator, such as a hydraulic accumulator. A bladder- or diaphragm-shaped, elastically flexible separating layer of the accumulator separates two media chambers from each other within the accumulator, in particular a gas working chamber from a fluid chamber.

BACKGROUND OF THE INVENTION

A pressure accumulator known from WO 2013/056834 A1 has at least one accumulator housing with at least one connection for a pressurizing medium, in particular in the form of a fluid, which fluid can be stored in the accumulator housing. A filling material is at least partially introduced into the accumulator housing and has cavities or forms at least one cavity for the at least partial receiving of this pressurizing medium. The inside of the accumulator housing is fully filled with the filling material, so that the filling material is in full-surface contact with a wall of the accumulator housing.

If, in the known solution, the filling material is formed as foam, in particular polyurethane foam, thickness differences in the foam material can be generated by multiple injections or applications of foam. It is then advantageously possible to obtain a gradient-type structure of the foam material such that a very thick material is used on the inlet side of the accumulator. That material then changes in the direction of the opposite side of the accumulator housing with increasingly open pores or with lesser thickness. At the point of entry of the pressurizing medium into the accumulator housing body, an increased resistance can then be built up in that the barrier property of the foam or of another filling material is increased accordingly.

A pressure accumulator in the form of a hydraulic accumulator known from WO 2013/056835 A1 has at least one elastomeric separating element, preferably in the form of a separating diaphragm or separating bladder, which divides the accumulator housing into at least two working chambers. One of the working chambers receives the one pressurizing medium, in particular in the form of a fluid. The other working chamber receives the pressurizing medium, in particular in the form of a working gas, such as nitrogen gas. A foam filling material is at least partially introduced into the accumulator housing, which filling material is delimited or surrounded by the separating element.

In order to define the storage capacity in the accumulator housing accordingly, the filling material, preferably of a polyurethane foam material, can be introduced as a solid form block into the accumulator with a predeterminable volume level. The filling material then creates a cavity at least inside the accumulator housing, which cavity can be filled with the respective working medium (fluid and/or gas). The filling material preferably is introduced in an already hardened, cellular structure as an open-pore finished foam form block into the cavity of the respective accumulator housing of a pressure accumulator.

Depending on the formation of the completely designed and produced foam-like filling material before its installation in the accumulator, a high storage capacity is obtained for the then modified accumulator. In addition, the stiffness of damping during operation of the accumulator can be correspondingly influenced. Furthermore, during operation of the accumulator, a homogenous temperature profile is obtained for the respective working media to be introduced and removed. The introduction of the already fully-foamed, in other words, hardened foam material and filling material, if appropriate, together with the accumulator bladder, into the accumulator nevertheless often presents issues. The free available installation openings of the respective accumulator housing are kept small for system-related reasons, such that avoiding damage to the foam and/or to the elastomer material of the separating layer during the introduction into the accumulator housing is not possible. In particular, dividing the accumulator housing into several segments in order to simplify the introduction of the foam is often necessary.

The segments must subsequently be joined together by a laser joint welding for example, which on the one hand involves intensive work and on the other hand compromises the homogeneity and thus the pressure stability of the wall of the accumulator housing. Because of the large number of work processes that this involves, the production of the known pressure accumulator solutions is time-intensive and thus cost-intensive. The costly production also prevents the design of the respective accumulator as a disposable component, which is a requirement of the rapidly modernizing market that is efficiency-oriented.

SUMMARY OF THE INVENTION

Based on this prior art, the problem addressed by the invention is therefore to provide an improved method for producing a pressure accumulator which, while retaining the advantages of the prior art such as the increased storage capacity and the temperature stability and pressure stability, helps to avoid the described disadvantages, and which can then be designed in a technically reliable and functionally reliable manner and can be produced with low labor costs and in a cost-efficient manner.

This problem is basically solved by a method for producing a pressure accumulator having the following method steps that are used in the production of the pressure accumulator:

- introducing of a flow-capable, preferably fluid, foam material into the pressure accumulator, which is at least partially surrounded by the separating layer,
- hardening of the foam material in the pressure accumulator, and thereby
- building up a pressure gradient, in which the increasingly hardening foam material expands the separating layer from an original partially-filled starting state towards a final state, in which the accumulator is finally filled with the hardened foam.

By contrast with the known methods therefore, an already finished foam is not introduced in block form into the pressure accumulator with its separating layer. Rather a flow-capable, preferably fluid, foam material is introduced which, after its introduction into the pressure accumulator and with the expansion of the separating layer, which occurs simultaneously during the hardening process, to its maximum designed expanded state in the accumulator, forms the finished foam block in-situ. All of the important steps in the foam creation towards the finished state then occur directly and immediately in the accumulator and not outside of same.

The pressure gradient to be built up in order to expand the separating layer from a starting state towards its final state can be realized in a gravity-assisted manner. In other words, the introduced fluid foam material at least partially expands the separating layer simply due to its weight. However, this process takes place predominantly due to volumetric expansion when the foam material hardens with the associated cavity cell formation.

Particularly advantageously, this foam material input is in an upright manner, in other words, in the vertical orientation of the longitudinal axis of the accumulator. Because the foam material arrives in the accumulator in a flow-capable, preferably fluid state, damage to the foam material is prevented. Due to the expansion of the separating layer by the introduced, rapidly solidifying foam material, the separating layer can be fully filled with the foam material upon its hardening, so that a particularly high storage capacity of foam filling material to be introduced is obtained. If, during hardening of the foam material, bubble formation occurs for the purpose of creation of the preferably open-pore foam structure, any excess material can be expelled from the inlet point for the foam material back into the environment. This means that there is neither overstressing of the pressure accumulator wall or of the elastically flexible, in particular elastomeric separating layer, which is often in the form of an accumulator bladder or in the form of a separating diaphragm of the kind that is customary in diaphragm accumulators.

In one preferred embodiment of the method according to the invention, by the hardening foam material that is introduced into the pressure accumulator and with build-up of the associated pressure gradient, the bladder-shaped or diaphragm-shaped separating layer is expanded until such time as a valve provided on the fluid side of the accumulator, in particular in the form of a poppet valve, is closed. On the basis of the described functional position of the valve, an easily verifiable conclusion can be reached as to whether there is sufficient foam material in the accumulator after the hardening process, or whether this is not yet the case, which can trigger an additional top-up operation as described above.

In one particularly preferred embodiment of the method according to the invention, the initially flow-capable, in particular fluid foam material is sprayed or injected by a lance-shaped input device into the accumulator housing with the separating element. The one free end of the input device preferably opens into the top half of the pressure accumulator and is to this extent guided in the gas working chamber of the accumulator. The input device furthermore penetrates the gas connection of the accumulator and is connected by its other free end to an admixing device for the foam material. This procedure permits introducing the not yet hardened foam material into the pressure accumulator in a very targeted manner and, after removal of the input device from the accumulator, the hardening operation for the foam material can take place in an unimpeded manner.

By the admixing device, which is formed as a dynamically or statically functioning mixing head, components of the flow-capable, in particular fluid, foam material are supplied to the mixing head via at least two supply lines connected to the mixing head in order to subsequently be introduced, in a corresponding predeterminable mix ratio and via the lance-shaped input device, into the gas working chamber of the accumulator, which gas working chamber is separated via the separating layer from the fluid chamber of the accumulator.

In particular, by the mixing head the lance-shaped input device can be rotated about its longitudinal axis inside the accumulator body, so that a consistent foam material input towards the separating layer of the accumulator is realized. Several dispensing nozzles also are able to be arranged at predeterminable discrete intervals from one another on the free opening end of the input device in order to allow standardization of the input. Furthermore, the input device can be adjusted, if necessary, viewed in the longitudinal direction of the accumulator, with respect to its effective axial input length, in order to then allow coverage of different accumulator sizes.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure.

DETAILED DESCRIPTION OF THE INVENTION

Figure 3:
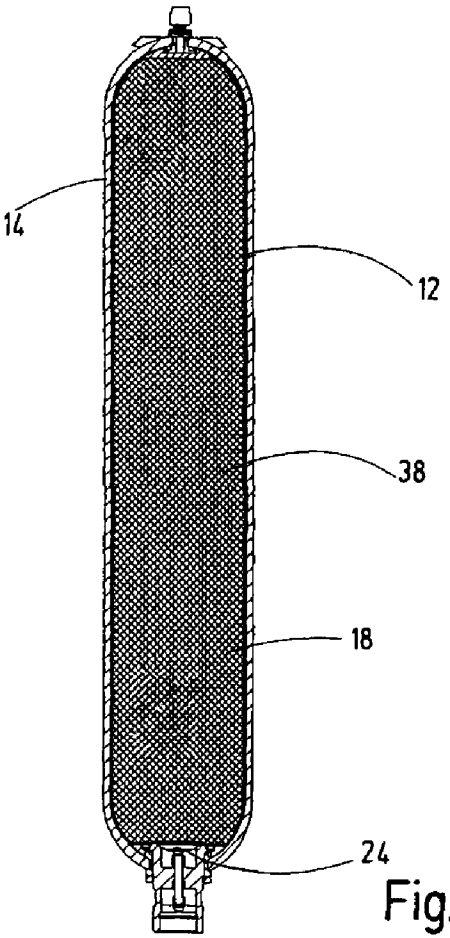
FIGS. 1 to 3 show a pressure accumulator in the form of a hydraulic accumulator with an accumulator bladder in different foam filling and production states according to an exemplary embodiment of the invention.

The hydraulic accumulator 10 depicted in the figures is designed as a bladder accumulator. The elastically flexible, in particular deformable, accumulator bladder 12 separates two media chambers from each other within a pressure accumulator housing 14. In particular, a gas working chamber 16 is separated from a fluid chamber 18, which chambers, in the subsequent operating state of the accumulator 10, receive a working gas, in particular in the form of nitrogen gas, and hydraulic oil, respectively. The accumulator housing 14 is formed substantially in one piece, is bottle-shaped and preferably is made of a steel material or die-cast material. The accumulator housing 14 can also be formed by a wrapped plastic laminate that is not depicted in detail, which housing is referred to as a liner construction in technical parlance. The accumulator bladder 12 forms the bladder-shaped, elastically flexible separating layer of the accumulator 10 and is pieced together, in particular vulcanized together, from sub-segments in accordance with the depictions of FIGS. 1 and 2. The construction of the accumulator bladder 12 in sub-segments is in particular suitable when, viewed in the axial length of the hydraulic accumulator 10, the pressure accumulator housing 14 has a correspondingly large length.

Figure 2:
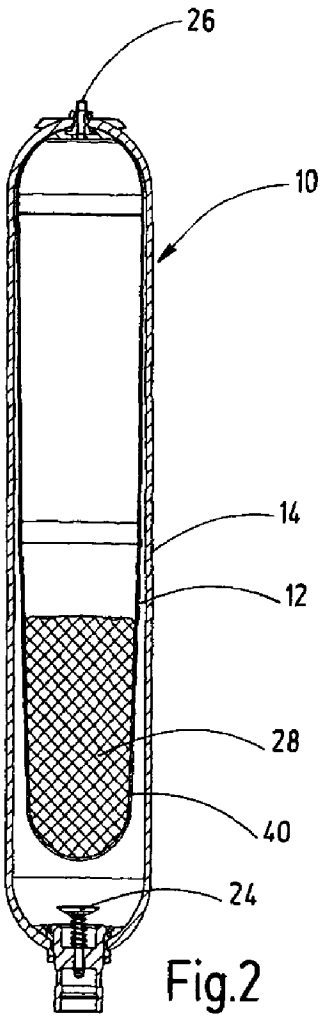
Figure 1:
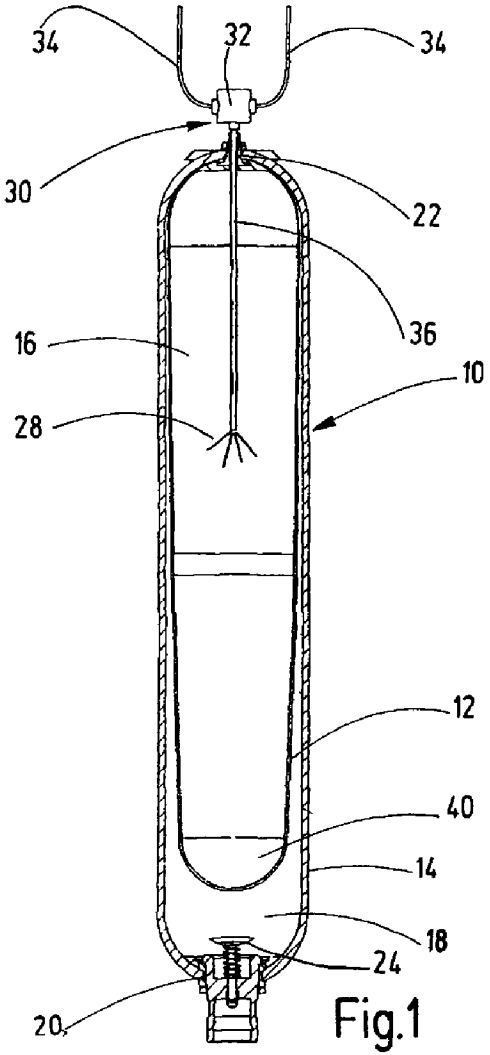

The accumulator housing 14 has on its opposite longitudinal end sides two openings 20, 22. The bottom opening 20 receives a conventional closing valve, such as a poppet valve 24. The top opening 22 is provided with a closing valve device 26 (cf. FIGS. 2 and 3), which serves for subsequent supply of the working gas and which, if necessary, permits top-up operations with the working gas. Otherwise, the closing valve device 26 usually remains closed during operation of the accumulator. If the poppet valve 24 is in an opened position, as depicted in FIGS. 1 and 2, the working fluid, commonly in the form of hydraulic oil, can reach the fluid chamber side 18 of the accumulator 10 and be stored there until the stored pressure quantity and/or filling quantity is in turn required in the hydraulic circuit (not depicted) to which the accumulator 10 can be connected. This operating method corresponds to standard accumulator operation, and accordingly it will not be addressed in further detail here. However, if the accumulator bladder 12 is in its fully elongated or expanded state, as depicted in FIG. 3, the accumulator bladder 12 presses by its bottom end with force-locking contact against the poppet valve 24 and closes the valve. An input pressure of the fluid medium is then required on the fluid side of the accumulator, which pressure is greater than the counter pressure in the accumulator bladder 12, in order to effect an opening operation for the poppet valve 24.

In order to obtain an operational hydraulic accumulator 10, the hydraulic accumulator must be correspondingly filled with a foam material, as will be described in detail below. For the input of the flow-capable, in particular fluid foam material, an admixing device 30 is employed. Admixing device 30 contains a statically or dynamically functioning mixing head 32 that, in accordance with the exemplary embodiment of FIG. 1, has two supply lines 34 connected to the mixing head 32 and that is to be placed or extends from the outside onto the accumulator 10 to be filled. Furthermore, a lance-shaped input device 36 is connected to the mixing head 32 on the bottom side thereof, with the one free end of the input device 36 opening into the top half of the pressure accumulator 10 and being guided in the gas working chamber 16. The other end the input device 36 penetrates the top opening 22 of the accumulator housing 14, which top opening is provided for the subsequent receiving of the closing valve device 26. For the input of the foam material, in accordance with the depiction of FIG. 1, the input device 36 is provided with corresponding spray openings or nozzle openings (not depicted in detail) in the region of the bottom end of the lance of the input device 36 in order to obtain a consistent foam input into the inside of the accumulator.

The foam components that can be supplied via the respective supply line 34 form, once they are brought together in the mixing head 32, a flow-capable mixture of polyols, isocyanate, catalysts, retarders, crosslinkers and stabilizers and, if appropriate, water. In particular, long-chain polyether polyols are used and the catalysts can be amine catalysts or tin catalysts. Diglycolamine is particularly preferably used as crosslinker material. However, amino compounds, butanediol and alcohols can also be used. As stabilizer input material, silicone compounds have proven to be successful. The foam material components can also be supplemented with commercially available flame retardants. The above-mentioned individual components can, having been be combined with one another in advance in an obvious manner, be fed to the mixing head 32 via the supply lines 34 for further input into the accumulator bladder 12. Preferably, the components are supplied to the mixing head 32 separately from one another in a consecutive sequence. The mixing head then initiates the mixing and the input via the input device 36.

If the polymer polyol used for the foam has hardened, a polyurethane (PU) soft foam 38 is created, which is crosslinked by the additional material or the additional components in the form of the crosslinker diglycolamine. The particular polyol used substantially produces the elastic foam behavior and the high recovery capability of the introduced hardened foam 38. The preferably open-cell foam 38 has a recovery capability of 97% to 98%. The above-mentioned 3D structure of the foam 38 ensures an optimal heat transfer.

As can be seen in particular from FIG. 2, the still fluid foam material 28 is collected in the bottom accumulator bladder end 40 with the input amount individually required for the respective accumulator type. The accumulator 10 is then closed in a pressure-tight manner via the closing valve device 26 at the top end. As a result of the introduced components of the foam material 28, the foam material 28 then hardens and thereby expands in volume up to the final state according to the depiction of FIG. 3, in which the poppet valve 24 is then closed. In particular, the build-up of a pressure gradient occurs during the hardening of the foam material 28 in the pressure accumulator 10. During that build-up of pressure, the increasingly hardening foam material 28 expands the separating layer in the form of the accumulator bladder 12 from the original partially filled starting state in accordance with the depiction of FIG. 2 towards the final state, in which the accumulator 10 is finally and fully filled with the hardened foam 38 with the poppet valve 24 being closed. Due to the recovery capability of the foam 38, in the case of an opening poppet valve 24, the foam can, by the fluid pressure of the hydraulic circuit (not depicted in detail) to which the accumulator 10 is connected, be forced back, in particular, compressed with regards to the open-porosity of the foam cells, so that the fluid chamber 18 in the hydraulic accumulator 10 can be filled with the oil medium until another retrieval occurs and it can then be stored there under pressure from the compressed foam material.

The desired volumetric weight for the finished foam 38 ranges from 50 g/dm$^3$ and 150 g/dm$^3$. The heat capacity of the PU foam 38 should be 20° C.>1 J/gK, and should particularly preferably be a value between 1.4 J/gK and 1.9 J/gK, with the latter value corresponding to an operating temperature of approximately 120° C. If the introduced PU soft foam 38 has a flame retardant added to it, it is then also possible to increase the heat capacity, in particular if the flame retardant is introduced into the foam 38 as a solid. The flow resistance, which is considered to be a measure for the porosity of the foam 38, should preferably be within a value range from 1400 to 3800 Ns/m$^3$. However, the elasticity of the foam 38 is in any case such that the foam 38 in the ready-for-use state of the accumulator 10 can be compressed by 40% of the maximum possible foam volume input. Higher values are possible. If a dry inert gas is inserted on the gas working chamber side 16, such as nitrogen, helium, argon, xenon, $CF_4$ or $SF_6$, for example, a temperature stability of between −40° C. and 140° C. is obtained in the case of a degree of crosslinking of the PU input material of >90% and when there are no volatile components.

Because the foam 38 is surrounded by the accumulator bladder 12 and also has no contact with the inside wall of the accumulator housing 14 or with the respective sealing materials (TPU, NBR, IIR, ECO, FKM), which are standard in accumulator construction, there is also no corresponding chemical reaction with the sealing material, which contributes to the longevity of the accumulator construction. If damage results in destruction of the hardened foam material 38 in the operational state of the accumulator according to FIG. 3, the accumulator 10 itself does not become unuseable, instead there is merely a "return" to the behavior of a standard accumulator without foam input. In addition, the above-mentioned sealing system of the accumulator 10 manages with a reduced lubricating film on the gas side and thus conforms with dry-run properties. If, contrary to expectations, foam particles or foam cells pass through via the seal or the separating layer material to the fluid side 18 of the accumulator 10, this input of foreign materials into the fluid does not lead to damage of the hydraulic system, because the PU foam does not have any observable damaging effect in this regard.

As another embodiment, which is not however depicted or described in detail, the possibility exists to apply the method according to the invention together with the foam input in pressure accumulators which are designed as diaphragm accumulators, of the kind presented in the prior art for example in FIGS. 1 and 2 of the already mentioned PCT publication WO 2013/056835 A1.

With the hydraulic accumulator solution according to the invention and using the described production method, accumulators can be realized having increased storage capacity and with good temperature stability and pressure stability, which prove to be very functionally-reliable during operation and which can be produced with little labor outlay and expense. There is no equivalent of this solution in the prior art.

While one embodiment has been chosen to illustrate the invention, it will be understood by those skilled in the art that various changes and modifications can be made therein without departing from the scope of the invention as defined in the claims.

The invention claimed is:

1. A method for producing a foam body in a pressure accumulator, the method comprising the steps of:

providing a pressure accumulator with an elastically flexible separating layer separating a gas working chamber from a fluid chamber inside an accumulator housing of the pressure accumulator, the pressure accumulator comprising a valve in the fluid chamber movable between an open position and a closed position;

introducing a flowable foam material in the gas working chamber of the pressure accumulator so as to be at least partially surrounded by the separating layer;

hardening the flowable foam material in the gas working chamber of the pressure accumulator; and building up a pressure gradient as the flowable foam material increasingly hardens and expands the separating layer from an original, partially-filled starting state to a final state in which the pressure accumulator is finally and fully filled with the hardened foam and the separating layer, wherein the hardening of the flowable foam material in the gas working chamber of the pressure accumulator and the building-up of the pressure gradient occur while the gas working chamber is closed to an environment surrounding the pressure accumulator, and wherein the pressure gradient expands the separating layer until the separating layer moves the valve from the open position to the closed position.

2. A method according to claim 1 wherein the flowable foam material is introduced into the pressure accumulator as a fluid.

3. A method according to claim 1 wherein said separating layer is a bladder or diaphragm shaped.

4. A method according to claim 1 wherein the valve comprises a poppet valve.

5. A method according to claim 1 wherein the flowable foam material is sprayed or injected into the gas working chamber of the pressure accumulator by a lance-shaped input, the input having a first free end opening in the pressure accumulator and extending into the gas working chamber by penetrating a gas connection of the pressure accumulator, the input having a second free end outside of the pressure accumulator connected to an admixer.

6. A method according to claim 5 wherein individual components of the flowable foam material are supplied by a dynamically or statically functioning mixing head of the admixer via at least two supply lines connected to the mixing head, a corresponding mix ratio of the individual components being introduced into the gas working chamber of the pressure accumulator from the admixer via the input.

7. A method according to claim 6 wherein the individual components comprise a polyol, a foaming agent and a crosslinker.

8. A method according to claim 7 wherein the polyol is a polyether polyol.

9. A method according to claim 7 wherein the foaming agent comprises water.

10. A method according to claim 7 wherein the crosslinker comprises diglycolamine.

11. A method according to claim 7 wherein the individual components also comprise a catalyst, a flame retardant and a stabilizer.

12. A method according to claim 11 wherein the catalyst is an amine catalyst or a tin catalyst.

13. A method according to claim 11 wherein the stabilizer is a silicone compound.

14. A method according to claim 1 wherein the hardened foam in the gas working chamber of the pressure accumulator has open cells with a recovery capacity as a three dimensional structure of 97 to 98 percent.

15. A method according to claim 1 wherein the hardened foam in the gas working chamber of the pressure accumulator has a volumetric weight in a range of 50 $g/dm^3$ to 150 $g/dm^3$.

16. A method according to claim 1 wherein the hardened foam in the gas working chamber of the pressure accumulator has a heat capacity at 20° C. greater than 1 J/gK.

17. A method according to claim 1 wherein the flowable foam material has a flow resistance in a range from 1400 to 3800 $Ns/m^3$.

18. A method according to claim 1 wherein the separating layer is a closed accumulator bladder with dry inert gas in the gas working chamber having a temperature stability in a range from −40° C. to 140° C.

19. A method according to claim 1 wherein cells in the hardened foam when finished hardening are in a range of 0.01 $mm^3$ to 375 $mm^3$.

* * * * *